US005596909A

United States Patent [19]

Cox et al.

[11] Patent Number: 5,596,909

[45] Date of Patent: Jan. 28, 1997

[54] CONTROL LEVER ASSEMBLY

[75] Inventors: Marvin L. Cox; Anthony F. Beugelsdyk; Ted E. Deubner; Donald R. Novak; Arthur L. Urban, all of Wichita, Kans.

[73] Assignee: Wescon Products Company, Wichita, Kans.

[21] Appl. No.: 379,347

[22] Filed: Jan. 27, 1995

[51] Int. Cl.[6] ..... G05G 1/04

[52] U.S. Cl. ..... 74/523; 74/538; 74/531; 74/475

[58] Field of Search ..... 74/335, 475, 523, 74/533, 527, 531, 534, 535, 537, 538, 540, 541, 551.2; 403/326, 327, 329, 330

[56] References Cited

U.S. PATENT DOCUMENTS

| | | | |
|---|---|---|---|
| D. 338,441 | 8/1993 | Deubner . | |
| 2,361,920 | 11/1944 | Barrett | 74/538 |
| 2,922,669 | 1/1960 | Hansen | 74/527 |
| 3,526,040 | 9/1970 | Young | 403/330 |
| 4,189,954 | 2/1980 | Nakamura et al. | 74/475 |
| 4,438,658 | 5/1984 | Carlson . | |
| 4,454,784 | 6/1984 | Shimano | 74/527 |
| 4,813,214 | 3/1989 | Barnard et al. . | |
| 4,949,591 | 8/1990 | Roelle . | |
| 5,000,059 | 3/1991 | Barnard | 74/523 |

*Primary Examiner*—Rodney H. Bonck
*Assistant Examiner*—Chong H. Kim
*Attorney, Agent, or Firm*—Hovey, Williams, Timmons & Collins

[57] ABSTRACT

A control lever assembly includes a mounting bracket on which a control lever and detent plate are supported. The bracket presents a generally planer sliding surface in which a detent element is formed. The control lever and detent plate are supported on the bracket for movement across the sliding surface, and the detent plate includes a finger that is supported for pivotal movement about an axis extending in a direction parallel to the sliding surface. A pair of opposed side walls are provided on the detent plate for guiding the pivotal movement of the finger while preventing the finger from shifting relative to the plate along the pivot axis of the finger. A spring is provided for biasing the finger against the sliding surface so that when the lever is pivoted to a position in which the finger is aligned with the detent element, the finger is forced into engagement with the element and holds the lever in that position.

13 Claims, 3 Drawing Sheets

CONTROL LEVER ASSEMBLY

BACKGROUND OF THE INVENTION

1. Field of the Invention

The present invention relates generally to mechanical control systems and, more particularly, to a control lever assembly having a lever that is shiftable into and out of at least one detented position.

2. Discussion of the Prior Art

Mechanical control systems are commonly used in powered lawnmowers for permitting remote control of the speed and operation of the motor from the handlebar at the rear of the mower. A typical control system includes a sheathed innerwire extending between an actuator on the motor and a control lever assembly mounted on the handlebar, and the sheath guides axial movement of the innerwire in both tension and compression to permit bi-directional operation of the actuator from the control lever assembly.

It is conventional to provide a control lever assembly having a lever that is connected to the innerwire and is pivotal between a plurality of positions on the handlebar to permit control of the motor. Movement of the lever is restricted at a plurality of different detented positions provided across the range of movement of the lever, e.g. at an idle position, a maximum throttle position, and possibly a choke position.

In a known arrangement for providing this detented restriction of lever movement, a depression is formed in a bracket of the assembly opposing the lever, and a protruding button is formed in the lever that is sized for nesting receipt in the depression. By providing this construction, when the lever is moved over the depression, the button engages the depression causing the lever to click into the detented position.

Numerous problems arise as a result of this construction. For example, because the button is formed in the lever, the entire lever moves into and out of engagement with the depression in the detented position. As a result, the lever shifts toward the bracket when moved into the detented position and away from the bracket when moved out of the detented position. In order to accommodate this shifting of the lever, any cover for the assembly must include a slot of a width sufficient to permit both pivotal movement and lateral shifting of the lever. The larger this slot is, the easier it is for dirt and debris to enter the assembly and ruin its operation.

OBJECTS AND SUMMARY OF THE INVENTION

It is an object of the present invention to provide a control lever assembly for use in any of various mechanical devices such as lawnmower throttles and bicycle gears, wherein the assembly provides improved operation and an increased life relative to conventional devices.

It is another object of the invention to provide a control lever assembly having a lever that does not shift laterally into or out of engagement with the bracket at each detented position, but rather continues to move along a planer path as an independent detent element supported on the lever engages and disengages the bracket. Thus, it is a goal of the invention to decouple lever movement from operation of the detent mechanism employed in the assembly.

In accordance with these and other objects evident from the following description of a preferred embodiment of the invention, a control lever assembly is provided that includes a mounting bracket, a control lever and a detent plate.

The bracket presents a generally planer sliding surface and includes a detent element formed in the surface. The control lever is supported on the bracket for movement across the sliding surface, and the detent plate is retained between the lever and bracket. The detent plate includes a finger that is supported for pivotal movement into and out of engagement with the detent element about an axis extending in a direction parallel to the sliding surface. The plate includes a guide means for guiding pivotal movement of the finger relative to the plate while preventing relative movement between the plate and finger along the pivot axis of the finger. A biasing means is provided for biasing the finger against the sliding surface.

By providing a construction in accordance with the present invention, numerous advantages are achieved. For example, by providing a detent plate including a finger independent of the lever for engaging the detent element of the bracket, the lever is guided for pure pivotal movement and does not shift laterally into and out of engagement with the bracket detent element. In addition, the detent plate maintains the spacing between the control lever and the bracket, and clears debris from the bracket surface as the lever is moved back and forth.

Another advantage of the invention is achieved by forming the detent plate of a synthetic resin material and interposing the detent plate between the lever and bracket so that minimal wear occurs as a result of these two elements rubbing together. This construction significantly increases the life of the assembly.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENT

Figures 1, 2, 3, 4, 5:
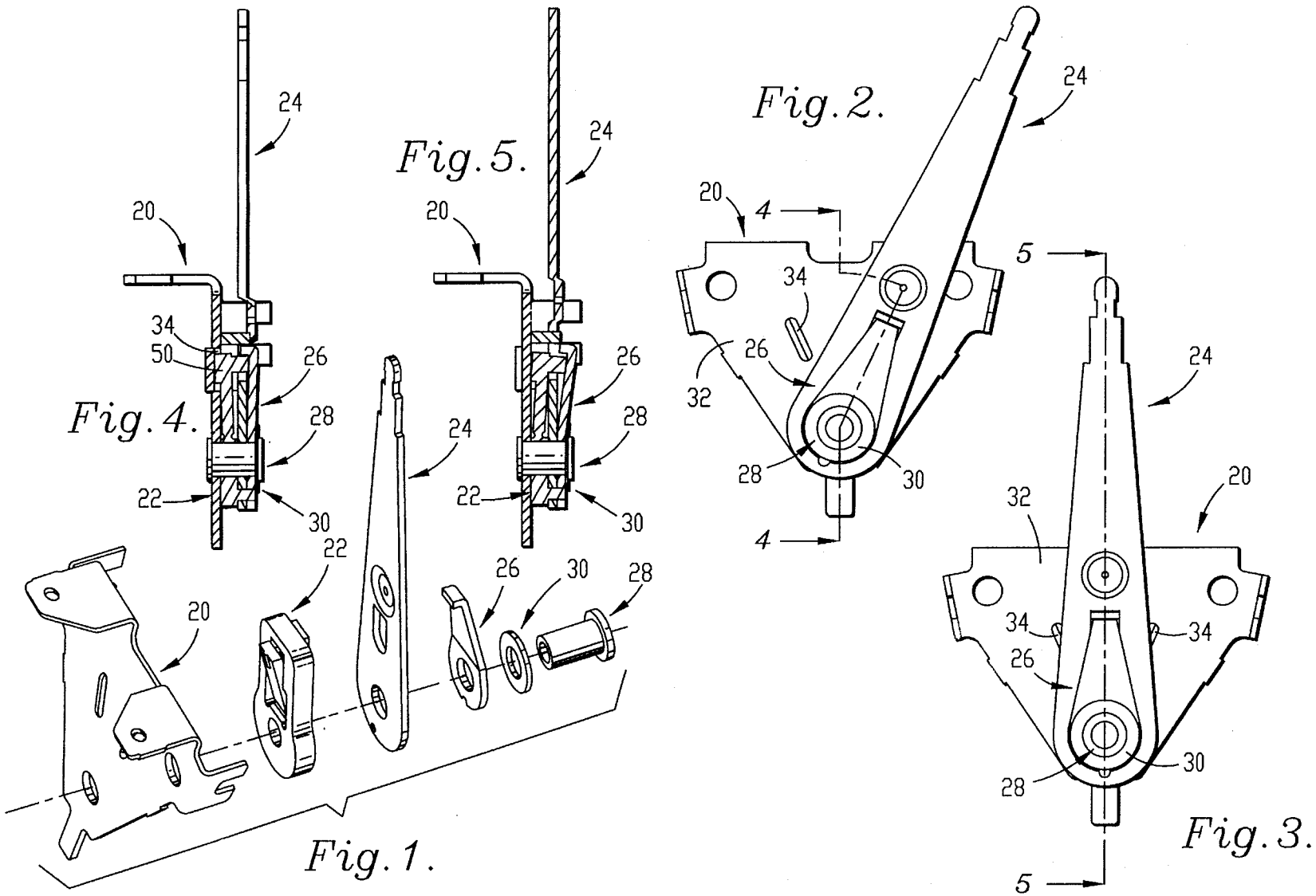
FIG. 1 is an exploded view of a control lever assembly constructed in accordance with the preferred embodiment.
FIG. 2 is a front elevational view of the control lever assembly, illustrating a lever of the assembly positioned in a detented position.
FIG. 3 is a front elevational view of the control lever assembly, illustrating the lever positioned between detented positions.
FIG. 4 is a sectional view taken along line 4—4 of FIG. 2.
FIG. 5 is a sectional view taken along line 5—5 of FIG. 3.

A control lever assembly for use in providing remote control of a lawnmower motor from the handlebar of the mower is illustrated in FIG. 1, and broadly includes a bracket 20, a detent plate 22, a control lever 24, and a spring plate 26. The detent plate, control lever and spring plate are supported by a rivet 28 for pivotal movement together relative to the bracket through a range of movement including at least one detented position, as shown in FIG. 2, and an infinite number of positions outside of the detented position, one of which is shown in FIG. 3. Returning to FIG. 1, a washer 30 is provided between the rivet and the spring plate to resist wear between those elements.

Figure 6:
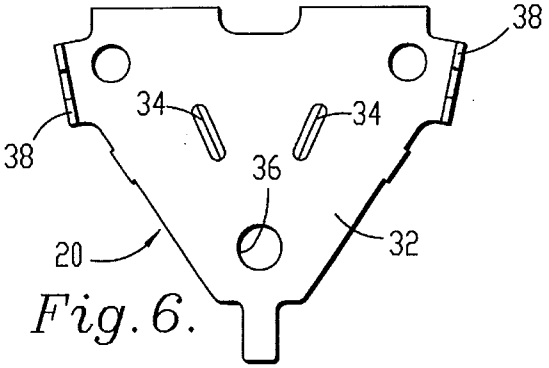
FIG. 6 is a front elevational view of a bracket of the assembly.

The bracket 20 is illustrated in FIG. 6, and is formed of sheet metal or the like. The bracket includes a pair of opposed surfaces, one of which defines a sliding surface 32 facing the control lever. A mounting hole 36 is formed in the bracket and extends in a direction perpendicular to the sliding surface. A pair of elongated detent elements 34 are formed in the sliding surface along radials extending from the mounting hole 36, and at spaced locations across the surface from one another. The detent elements preferably include depressions formed in the bracket.

The depression forming each detent element 34 is preferably a V-shaped groove presenting opposed side walls that are angled relative to one another by an angle of about 63°–73°. This angle is important in that if the angle is increased, less force is required to remove the lever from the detented position in engagement with the depression, and if the angle is decreased, greater resistance is provided against movement of the lever from the detented position.

Figure 7:
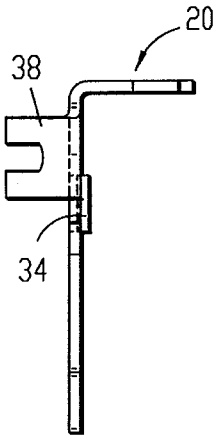
FIG. 7 is a side elevational view of the bracket.

Additional holes are formed in the bracket for permitting the bracket to be mounted on the handlebar of the lawnmower and for receiving a housing that substantially surrounds the assembly in use. In addition, as shown in FIG. 7, a pair of lugs 38 extend in a direction perpendicular to the sliding surface for limiting movement of the control lever across the surface.

Figure 12:
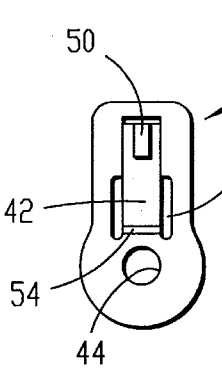
FIG. 12 is a front elevational view of a detent plate of the assembly.

The detent plate 22 is shown in FIG. 12, and is molded of a synthetic resin material as a unitary element. The detent plate includes a main body on which a finger 42 is hingedly connected for pivotal movement about an axis extending in a direction perpendicular to the axis of the mounting hole and parallel to the sliding surface. An exemplary material for use in the detent plate is an acetal resin such as that marketed under the trademark DELRIN, or other similar materials.

Figure 13:
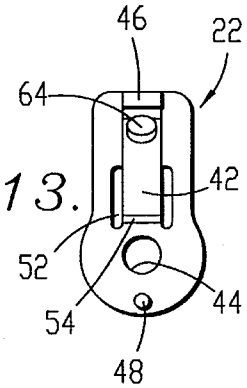
FIG. 13 is a rear elevational view of the detent plate.
Figure 14:
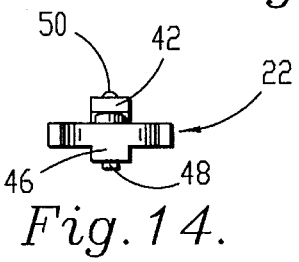
FIG. 14 is a top plan view of the detent plate.

The body of the detent plate is key-hole shaped, and includes a pair of opposed, planer surfaces, one of which is adapted to bear against the sliding surface 32 and the other of which rests against the lever 24. A mounting hole 44 extends through the body in a direction perpendicular to the planer surfaces, and defines a pivot axis about which the detent plate may be pivoted relative to the bracket. As shown in FIG. 13, the plate surface facing the lever includes upper and lower posts 46, 48 that protrude from the surface for retaining the detent plate in a fixed position relative to the lever. As shown in FIG. 14, the lower post 48 protrudes slightly beyond the upper post 46 so that the lower post extends completely through the lever for engagement with the spring plate 26, as described below.

The finger 42 of the detent plate is generally rectangular in shape, as shown in FIG. 12, and includes a free upper end and a lower end that is hingedly connected to the body of the plate at a position spaced slightly above the mounting hole. On the front surface of the finger facing the bracket a nose 50 is provided adjacent the free end of the finger. The nose is preferably triangular, presenting a pair of side walls that are angled relative to one another by the same angle as is provided between the side walls of the depression in the bracket. Thus, the nose defines a second detent element that nests in the depressions when the lever is moved to each of the detented positions.

A protrusion 64 is provided adjacent the free end of the finger on the rear surface opposite the nose 50, and presents a bearing surface against which the spring plate bears in use.

As shown in FIG. 13, the body of the detent plate 22 includes a generally rectangular opening 52 extending through the body in alignment with the finger, and the finger is received within this opening. Preferably, the opening is stepped, presenting a lower region having a width greater than the width of the finger, and an upper region having a width less than the lower region.

The space between the side walls of the lower region and the finger facilitate molding of the detent plate. The side walls of the upper region of the opening are tapered slightly toward one another in a direction away from the bracket, and the side walls of the finger are also tapered slightly in the same direction so that when the finger pivots into the body a predetermined distance, the finger nests in the opening and zero clearance exists between the finger and the body.

The angle of taper of the side walls of the opening and finger is very slight, and also serves as a draft angle for facilitating molding of the detent plate. As a result of providing this angle, when the finger is pivoted toward the bracket, some clearance does develop between the finger and the side walls of the opening. However, this clearance does not exceed 0.003 inches throughout the desired range of movement of the finger, and thus the side walls of the body restrict the finger from moving from side to side within the opening in a direction along the axis about which the finger pivots. As a result, only planer pivotal movement of the finger is permitted within the opening.

Figure 15:
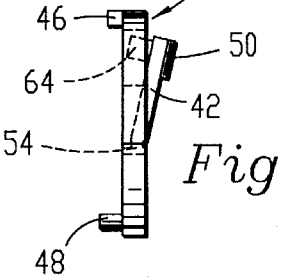
FIG. 15 is a side elevational view of the detent plate.

As shown in FIG. 15, the hinge 54 at the base of the finger is formed by reducing the thickness of the finger along a horizontal line at the bottom of the opening. Preferably, the hinge is not relied upon to provide any substantial biasing force on the hinge toward the bracket, and the spring plate 26 is relied upon almost exclusively to provide this function. Because synthetic resins have memory, there would be a tendency for the biasing force of the hinge to weaken over time if used as a spring.

Figure 10:
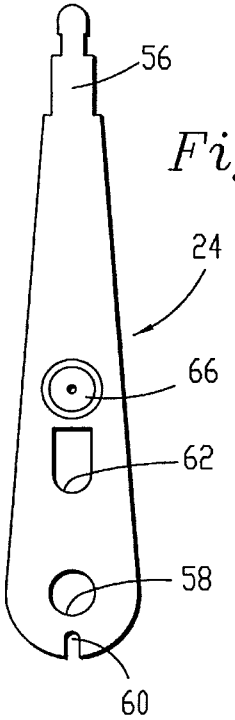
FIG. 10 is a front elevational view of the lever.

The control lever 24 is illustrated in FIG. 10, and is formed of an elongated piece of sheet metal presenting opposed planer surfaces and upper and lower axial ends. The upper end of the lever includes a stepped region 56 defining a means for permitting a knob or the like to be retained on the lever.

A mounting hole 58 is formed in the lever adjacent the lower end and extends in a direction perpendicular to the planer surfaces of the lever. The mounting hole defines a pivot axis about which the lever may be pivoted when assembled on the bracket. An elongated hole 60 extends through the lever beneath the mounting hole, and is of the same diameter as the lower post 48 of the detent plate so that the lower post is received in the hole. Another hole 62 is formed in the lever above the mounting hole and is of a width equal to the width of the upper post 46 for receiving the upper post. The cooperation between the posts 46, 48 and the holes 62, 60 fixes the detent plate relative to the lever and locks the plate against pivoting relative to the lever.

The upper hole 62 has a height greater than the height of the upper post 46 so that the finger is accessible through the hole from the opposite side of the lever. As shown in FIG. 15, the protrusion 64 on the finger 42 extends through the hole in the lever into engagement with the spring plate so that the spring plate biases the finger toward the bracket.

Figure 11:
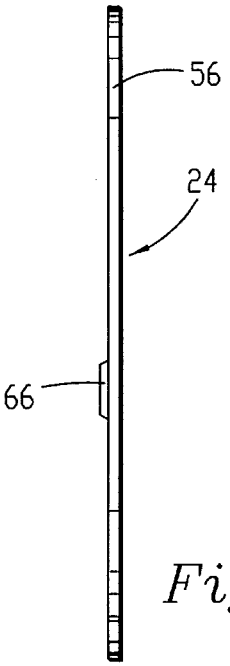
FIG. 11 is a side elevational view of the lever.

Returning to FIG. 10, a boss 66 is formed in the lever above the upper hole, and defines a means for connecting the lever to a control innerwire or the like that is used to effect remote control of a motor actuator or the like. Preferably, as shown in FIG. 11, the boss protrudes from the lever to accommodate a control innerwire in the preferred assembly. Any other connection expedient may also be used in addition to or in place of the boss.

Figure 8:
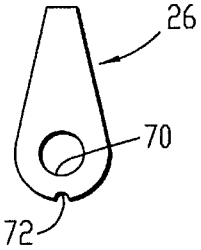
FIG. 8 is a front elevational view of a spring of the assembly.
Figure 9:
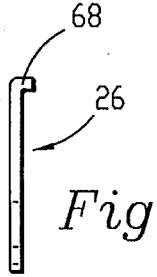
FIG. 9 is a side elevational view of the spring.

Turning to FIG. 8, the spring plate 26 is metallic, and includes a large diameter rounded lower end and an opposed, bent upper end 68, shown in FIG. 9. A mounting hole 70 is formed in the plate adjacent the lower end and extends through the plate in a direction perpendicular to the opposed surfaces of the plate. The mounting hole defines a pivot axis about which the spring plate may be pivoted relative to the bracket when assembled.

A notch 72 is formed in the lower end of the plate for receiving the lower post 48 of the detent plate, and the bent upper end of the spring plate extends into the upper opening 62 of the lever and is of a width substantially equal to the width of the upper opening. Thus, the spring plate is fixed to the lever and is not permitted to pivot relative to the lever.

The bend in the upper end of the spring plate serves an additional function in that it provides a visual indication of the proper orientation of the spring plate on the assembly. As shown in FIG. 1, the spring is preferably formed with a slight bend to improve the biasing action of the spring against the finger, and it is necessary to orient the spring plate properly during assembly in order to obtain desired biasing action. Because the bent end of the plate is easier to spot than the slight bend across the center of the plate, it simplifies assembly of the elements. With regard to the slight bend formed in the center of the plate, it is preferred to position it horizontally across the spring plate just above the mounting hole. However, other configurations may also be used.

The washer 30 is formed of a synthetic resin, and is provided between the spring plate and the head of the rivet during assembly so that wear does not result from relative movement between the spring plate and the rivet. The rivet 28 is conventional, and is preferably inserted through the washer and the various mounting holes 70, 58, 44, 36 during assembly, and then deformed against the bracket to fix the rivet on the bracket while permitting relative pivoting movement of the detent plate, lever and spring plate as a unit.

As shown in FIG. 5, during construction of the control lever assembly the detent plate 22 is attached to the control lever 24 with the posts 46, 48 extending through the openings 62, 60 and with the protrusion 64 of the finger 42 extending through the upper opening 62. The detent plate 22 and lever 24 are positioned on the rivet 28 along with the spring plate 26 and washer 30, and the rivet is inserted through the mounting hole of the bracket and deformed so that the rivet is fixed to the bracket and does not move.

The detent plate 22 functions as a spacer between the bracket sliding surface 32 and the control lever 24 and prevents the lever from contacting the sliding surface when pivoted. Thus, no wear occurs between the lever and the bracket, and the wear caused by rubbing between the mounting plate and the synthetic resin of the detent plate is substantially less than exists in conventional metal-against-metal constructions.

In addition, the body of the detent plate rubs against the sliding surface when the lever is pivoted and wipes away any debris that has accumulated on the surface or in and around the depressions. Thus, the detent plate keeps the sliding surface clean, prolonging the life of the assembly.

When the lever is pivoted to a position in which the nose of the finger is aligned with one of the depressions, as shown in FIG. 4, the spring plate biases the finger toward the sliding surface causing the nose to nest in the depression. In this detented position, the lever is retained against pivoting movement, and an increased pivoting force must be exerted on the lever in order to move it. Preferably, by constructing the depressions and nose as described above, a force of 12 lbs. must be used to move the lever from the detented position, whereas only 3 lbs. of force is necessary to move the lever back and forth across the sliding surface outside of the detented positions. This force is desired to provide enough force on the finger to hold the lever in any adjusted position outside of the detented positions. As mentioned, by decreasing the angle between the side walls of the depressions and the nose of the finger, this force may be increased, and by increasing the angle, the force may be decreased.

Figure 17:
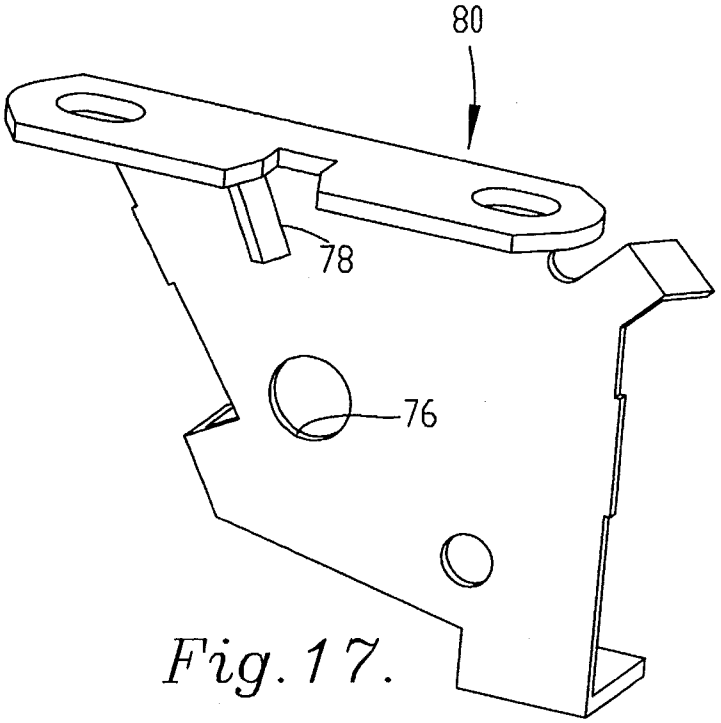
FIG. 17 is a perspective view of a second alternate construction of the bracket.
Figure 16:
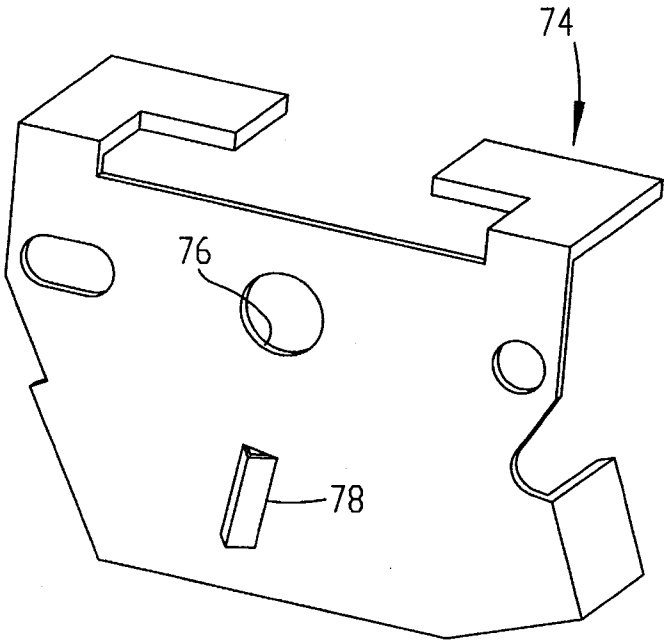
FIG. 16 is a perspective view of a first alternate construction of the bracket.

An alternate bracket construction 74 is illustrated in FIG. 16, and includes a mounting hole 76 and a single detent element 78. As with the preferred embodiment described above, the detent element 78 is preferably a depression formed in the bracket and sized for receipt of the finger nose of the detent plate when the lever is moved into alignment with the depression. Yet another alternate bracket construction 80 is illustrated in FIG. 17. The principle difference between these bracket constructions and the construction shown in the other figures resides in the particular arrangement for mounting the bracket on a lawnmower or the like.

Although the present invention has been described with reference to the preferred embodiment illustrated in the attached drawing figures, it is noted that substitutions may be made and equivalents employed wherein without departing from the scope of the invention as recited in the claims.

What is claimed is:

1. A control lever assembly comprising:

a mounting bracket presenting a generally planer sliding surface and including a detent element formed in the surface;

a control lever supported on the bracket adjacent the sliding surface for movement across the sliding surface, the control lever defining a first pivot axis about which the lever pivots relative to the mounting bracket;

a detent plate including a finger that is supported on the plate for pivotal movement into and out of engagement with the detent element about a second pivot axis extending in a direction parallel to the sliding surface and perpendicular to the first pivot axis, the plate including a guide means for guiding pivotal movement of the finger relative to the plate while preventing relative movement between the plate and finger in a direction parallel to the second pivot axis;

a positioning means for positioning the detent plate between the control lever and the bracket, and for securing the detent plate to the lever for pivotal movement relative to the bracket, and a spring plate mounted on the lever for biasing the finger against the sliding surface.

2. A control lever assembly as recited in claim 1, wherein the bracket includes a plurality of detent elements, each spaced from the other across the sliding surface.

3. A control lever assembly as recited in claim 1, wherein the detent element is a depression formed in the sliding surface and the finger includes a nose having a shape adapted to nest in the depression when the control lever is moved over the depression.

4. A control lever assembly as recited in claim 3, wherein the depression includes a pair of opposed side walls that are angled relative to one another by an angle of between about 63°–73°.

5. A control lever assembly as recited in claim 3, wherein the depression includes a pair of opposed side walls that are angled relative to one another by an angle of 68°.

6. A control lever assembly as recited in claim 1, wherein the bracket includes a mounting hole defining a pivot axis about which the lever is supported for relative pivoting movement.

7. A control lever assembly comprising:

a mounting bracket presenting a generally planer sliding surface and including a detent element formed in the surface;

a control lever supported on the bracket adjacent the sliding surface for movement across the sliding surface;

a detent plate supported on the lever and including a finger that is supported on the plate for pivotal movement into and out of engagement with the detent element about an axis extending in a direction parallel to the sliding surface; and a biasing means for biasing the finger against the sliding surface, the plate including a guide means for guiding pivotal movement of the finger relative to the plate while preventing relative movement between the plate and finger along the pivot axis of the finger, the finger including a pair of side walls and the guide means including a pair of interior walls formed in the detent plate, the interior walls restricting movement of the finger along the pivot axis, the side walls and interior walls being tapered so that the side walls engage the interior walls when the finger is moved a predetermined distance away from the sliding surface.

8. A control lever assembly comprising:

a mounting bracket presenting a generally planer sliding surface and including a detent element formed in the surface;

a control lever supported on the bracket adjacent the sliding surface for movement across the sliding surface;

a detent plate supported on the lever and including a finger that is supported on the plate for pivotal movement into and out of engagement with the detent element about an axis extending in a direction parallel to the sliding surface, the plate including a guide means for guiding pivotal movement of the finger relative to the plate while preventing relative movement between the plate and finger along the pivot axis of the finger; and a biasing means for biasing the finger against the sliding surface, the biasing means including a spring plate mounted on the lever opposite the detent plate, the lever including an opening through which the spring engages the finger to bias the finger toward the sliding surface.

9. A control lever assembly as recited in claim 8, further comprising a positioning means for positioning the detent plate and the spring plate on the control lever and preventing relative movement between the detent plate, the lever and the spring plate.

10. A control lever assembly as recited in claim 8, wherein the spring plate is bent along an axis extending in a direction parallel to the pivot axis of the finger.

11. A control lever assembly comprising:

a mounting bracket presenting a generally planer sliding surface and including a detent element formed in the surface;

a control lever supported on the bracket adjacent the sliding surface for movement across the sliding surface;

a detent plate supported on the lever and including a finger that is supported on the plate for pivotal movement into and out of engagement with the detent element about an axis extending in a direction parallel to the sliding surface, the plate including a guide means for guiding pivotal movement of the finger relative to the plate while preventing relative movement between the plate and finger along the pivot axis of the finger;

a biasing means for biasing the finger against the sliding surface; and a rivet for supporting the control lever, detent element and biasing means on the bracket for pivotal movement relative to the bracket.

12. A control lever assembly as recited in claim 11, wherein the biasing means includes a metal spring plate, and a washer is provided between the spring plate and the rivet, the washer being formed of synthetic resin.

13. A control lever assembly as recited in claim 1, wherein the bracket and control lever are formed of metal and the detent plate is formed of synthetic resin, the detent plate being supported between the bracket and the lever to space the lever from the bracket and prevent rubbing between the lever and bracket.

* * * * *